US006938394B2

(12) United States Patent
Perell

(10) Patent No.: US 6,938,394 B2
(45) Date of Patent: Sep. 6, 2005

(54) METHODS FOR MAKING BREACHING BUBBLE MECHANISMS FOR EASILY OPENING A SEALED PACKAGE

(76) Inventor: William Simon Perell, 301 Junipero Serra Blvd. Ste. 220, San Francisco, CA (US) 94127

( * ) Notice: Subject to any disclaimer, the term of this patent is extended or adjusted under 35 U.S.C. 154(b) by 0 days.

(21) Appl. No.: 10/831,964

(22) Filed: Apr. 26, 2004

(65) Prior Publication Data

US 2004/0231292 A1 Nov. 25, 2004

Related U.S. Application Data

(63) Continuation-in-part of application No. 10/246,893, filed on Sep. 19, 2002, now Pat. No. 6,726,364.

(51) Int. Cl.[7] ..... B65B 9/02; B65B 9/06; B65B 61/18

(52) U.S. Cl. ..... 53/412; 53/450; 53/455

(58) Field of Search ..... 53/403, 412, 450, 53/455

(56) References Cited

U.S. PATENT DOCUMENTS

| | | | | | |
|---|---|---|---|---|---|
| 3,120,336 | A | * | 2/1964 | Whatley, Jr. | 383/210 |
| 3,419,137 | A | * | 12/1968 | Walck, III | 206/364 |
| 4,759,472 | A | * | 7/1988 | Strenger | 222/92 |
| 5,107,658 | A | * | 4/1992 | Hustad et al. | 53/412 |
| 5,131,760 | A | * | 7/1992 | Farmer | 383/210 |
| 5,137,154 | A | * | 8/1992 | Cohen | 206/522 |
| 5,340,632 | A | * | 8/1994 | Chappuis | 428/71 |
| 5,806,280 | A | * | 9/1998 | Su | 53/412 |
| 5,942,076 | A | * | 8/1999 | Salerno et al. | 156/359 |
| 6,044,622 | A | * | 4/2000 | Brady et al. | 53/412 |
| 6,598,373 | B2 | * | 7/2003 | Sperry et al. | 53/403 |

* cited by examiner

*Primary Examiner*—John Sipos
(74) *Attorney, Agent, or Firm*—David E. Newhouse

(57) ABSTRACT

Methods for making a storage package having a breaching bubble(s) opening mechanism are described.

11 Claims, 2 Drawing Sheets

10
10M
10C
14
Article
10A
16
12A
12E
14I
14O 14U
14L
10M
10A
16

16F 16U
16L 16U
16L
16B 16U
16L 16U
16L

METHODS FOR MAKING BREACHING BUBBLE MECHANISMS FOR EASILY OPENING A SEALED PACKAGE

RELATED APPLICATIONS

This application is a continuation-in-part to U.S. patent application Ser. No. 10/246,893 filed Sep. 19, 2002, now U.S. Pat. No. 6,726,364, granted Apr. 27, 2004 entitled BUBBLE-SEAL APPARATUS FOR EASILY OPENING A SEALED PACKAGE, is incorporated herein by reference in its entirety, and claims any and all benefits to which it is legally entitled.

TECHNICAL FIELD

This invention relates to a sealed package having a bubble-seal for easy opening, and more particularly to bubbles which are edge breached to provide peel flaps for peeling opening the package.

BACKGROUND

In earlier times small packages of consumer goods such as snacks and candy bars were easy to open. The goods were wrapped in paper, light plastic, thin cellophane, or some other easy to tear closure material. These packages frequently had pull tabs or rip strings to assist the consumer. Some items were simply cradled in a folded tinfoil wrapper which slid out of a paper sleeve. Later, cost pressure and safety considerations drove the packaging industry toward today's difficult to open containers. Stronger enclosures reduced shipping and storage spoilage and retail handling losses. Thicker, tougher material was employed to minimize accidental and intentional puncturing. The enclosures became sterile, hermetically sealed cells to protect against moisture damage. In certain cases, tamper resistant features further hindered the easy opening of the packages. Pull tabs were no longer provided and the consumer frequently had to resort to scissors or a blade to open the package. The modern, shrink-wrap packaging of small consumer goods may present the ultimate challenge to the consumer.

U.S. Pat. No. 4,872,556 to Farmer shows a package with a bursting seal for controlling the discharge rate of a stored liquid or fluid commodity. The commodity is contained in a large storage chamber and dispensed through a smaller, adjacent discharge chamber. Pressure applied to the commodity in the storage chamber causes a storage seal between the two chambers to rupture, resulting in fluid flow from the storage chamber into the discharge chamber. Continued pressure on the storage chamber fluid causes a discharge seal to rupture permitting the fluid to discharge from the discharge chamber into the environment. The Farmer package and technique was not suitable for solid commodities. Major applied pressure was required to rupture both the storage seal and the discharge seal. This pressure is the only force at work to burst the package, and simultaneously ruptures the seals and discharges the liquid. The force is increased by the consumer until the commodity is discharged. The internal pressure in the chambers, may cause fluid leakage through existing small cracks and other flaws. The pressure may contribute to the development of additional flaws at weak places in the closure material. A sufficiently heavy pressure directly on the fluid commodity will cause a sudden failure of the seals and an explosive, squirt release of the contents.

U.S. Pat. No. 5,340,632 to Chappuis describes a padding element for packaging comprising an array of chambers, each of which can be partially filled with air and an apparatus for forming the array of chambers and inflating selected chambers inn the array partially with air as they being formed from two longitudinal webs of a synthetic foil material. The disclosures, teachings and methods of the apparatus described by Chappuis are adopted and incorporated into this application.

U.S. Pat. No. 5,942,076 to Salerno et al describes a machine for partially inflating cushions with air as they are being formed from a longitudinal tube of thermoplastic material. The disclosures, teachings and methods implicit in the machine described in Salerno et al are adopted and incorporated into this application.

U.S. Pat. No. 6,598,373 to Sperry et al described an apparatus for forming partially inflated containers from a web film longitudinally folded to provided two juxtaposed film plies with adjacent side edges and transverse heat seals across the longitudinally folded web film to provide pre-formed flexible containers 30, (FIG. 7) which are partially inflated with air as the juxtaposed, adjacent side edges of each pre-formed container are being sealed together. The disclosures, teachings and methods implicit in the apparatus described in Sperry et al are adopted and incorporated into this application.

SUMMARY

It is therefore an object of this invention to provide a method for manufacturing article storage and display packages with breaching bubble mechanisms which permits easy opening by a consumer. The invented methodology establishes one or more bubbles within a seal between two lamina of the packaging material along an edge to be opened. The consumer presses the bubble or bubbles separating the seal expanding the bubble(s) and forcing or urging them toward the edge of the package until the bubble breachs the edge of the package. The separated laminas of the packaging material after the edge breach, provides small peel flaps which the consumer may grasp and peel apart the sealed together packaging material forming the package providing access to the stored/displayed article.

In particular, an invented method is described for making an article storage package for having a breaching bubble(s) opening mechanism comprising the steps of:

(a) stacking two lamina materials one atop the other;

(b) establishing a top band seal between the two stacked lamina materials at a topside edge of a storage package having an outer band portion adjacent the topside edge, and an inner band potion spaced inward from the outer band portion forming a bubble band tube;

(b) establishing a top band seal between the two stacked lamina materials at a topside edge of a storage package having an outer band portion adjacent the topside edge, and an inner band potion spaced inward from the outer band portion forming a bubble band tube;

(c) partially inflating the bubble band tube with a fluid;

(d) establishing a plurality side edge band seals between the two stacked lamina materials each crossing the top band seal, each pair of side edge band seals forming a bubble region in combination with the outer and inner band portions of the top band seal and forming a chamber with an open bottom for receiving an article;

wherein an article can placed in the chamber via its open bottom, and bottom of the chamber sealed enclosing the article for storage.

Also an invented method is described for making a bubble seal apparatus for easily opening a pre-formed a package with an a chamber into which an article is placed and sealed, where the pre-formed package also has a chamber access region adjacent to, and above the chamber extending to the top edge of the package including the steps of:

establishing a breaching bubble in the chamber access region between opposed lamina of the packaging material proximate to the top edge of the package;

sealing the opposed lamina of packaging material of the chamber access region together around the breaching bubble between the sealed chamber and the top edge of the package;

wherein the bubble can be expanded towards the top edge of the package by applying pressure separating the opposed sealed together lamina material, until the bubble breaches the top edge of the package, the separated, opposed lamina material along the top edge breach becoming peel flaps which can be grasped and peeled apart separating opposed, sealed together lamina of material forming the package providing access to the article sealed in the chamber of the package.

An invented method is described for making a third embodiment of storage packages with breaching bubble(s) opening mechanisms, that includes the steps of:

forming a package with an enclosure material creating a chamber for receiving an article via a sealable gap, the package also having a chamber access region proximate a top edge of the package;

establishing a plurality of breaching bubbles between opposed lamina of the enclosure material of the chamber access region proximate to the top edge of the package;

sealing the opposed lamina of the enclosure material of the chamber access region together around each of the breaching bubbles in a band across the access region between the chamber and the top edge of the package;

wherein an article can be placed into the chamber via the sealable gap and the gap sealed and wherein the bubbles are expandable towards the top edge of the package by applying pressure progressively separating the sealed together, opposed lamina material, until the top edge of the package is breached, the separated, opposed lamina material along the top edge breach becoming peel flaps which can be grasped and peeled apart separating opposed, sealed together lamina of packaging material forming the package providing access to the article sealed and stored in the chamber of the package.

BRIEF DESCRIPTION OF THE DRAWINGS

Further objects and advantages of the package opening apparatus and the bubble-seal opening thereof will become apparent from the following detailed description and drawings (not drawn to scale) in which.

Figures 1A, 1B, 1C, 1D, 1E, 1F, 1G, 1H:
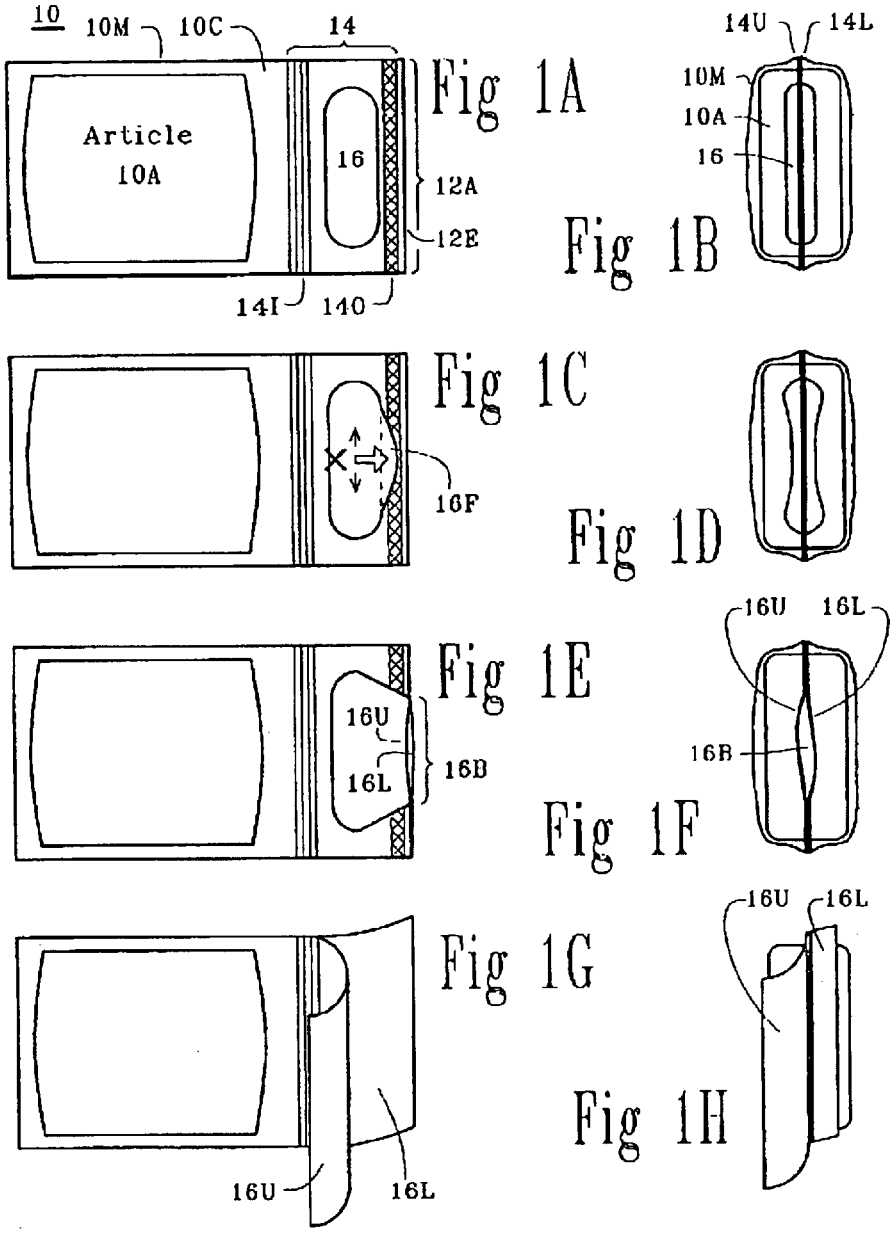
FIG. 1A is a side view of bubble-sealed storage package 10 showing stored article 10A and breaching bubble 16.
FIG. 1B is a end view of package 10 of FIG. 1A.
FIG. 1C is a side view of package 10 showing bubble 16 expanding under applied pressure at point "X"
FIG. 1D is a end view of package 10 of FIG. 1C.
FIG. 1E is a side view of package 10 showing bubble 16 forming edge breach 16B.
FIG. 1F is a end view of package 10 of FIG. 1E.
FIG. 1G is a side view of package 10 showing peel flaps 16U and 16L being peeled back to open chamber 10C.
FIG. 1H is a end view of package 10 of FIG. 1G.

The first digit of each reference numeral in the above figures indicates the figure in which an element or feature is most prominently shown. The second digit indicates related elements or features, and a final letter (when used) indicates a sub-portion of an element or feature.

REFERENCE NUMERALS IN DRAWINGS

The reference numerals employed in the figures specifying elements of the invented breaching bubble mechanism for storage bags designated areas follows: Storage Package 10, Stored Article 10A, Storage Chamber 10C, Enclosure Material 10M, Chamber Access Region 12A, Package Edge 12E, Band Seal 14 Inner Seal Portion 14I, 14L Lower Lamina, 14L Outer Seal Portion 14O, Upper Lamina 14U, Breaching Bubble 16, Edge Breach 16B, Separation Frontier 16F, Lower Peel Flap 16L, Upper Peel Flap 16U, Storage Package 20, Package Edge 22E, Adjacent Bubbles 26, Expanded Edge Breach 26B, Storage Package 30, Storage Chamber 30C, First Opening Site 34R, Second Opening Site 34L, Right Bubble Array 36R, Left Bubble Array 36L, Bubble Array 46, Arrow Bubble 56A, Texture Bubble 56T, Square Bubble 56S, Inner Seal portion 64I, Inward Expansion Stop 64S

General Embodiment—(FIGS. 1A–H)

An easily opened container or storage package 10 has enclosure material 10M forming storage chamber 10C within the package for containing stored article 10A. The enclosure material may be any suitable confining substance such as plastic, paper (with wood and/or cotton content) fabric, cellophane, or biodegradable matter. Thin mylar plastic forms a flexible film with hermetic properties, and is commonly used as a packaging material. Article 10A may be any tangible object (or objects) suitable for storage such as snacks, prepared foods, edibles generally, pharmaceuticals, manufactured products, agricultural commodities, or various household goods.

Chamber access region 12A proximate edge 12E of the package, provides entrance into the chamber and access to the stored article. Band seal 14 extends along the access region and is formed by opposed enclosure material. The band seal has upper lamina 14U and lower lamina 14L pressed into a sealing engagement. Breaching bubble 16 is enclosed between the opposed laminae within the band seal. The band seal has inner seal portion 14I and outer seal portion 140, both formed by opposed laminae material. The inner seal portion is between the bubble and the chamber. The outer seal portion is between the bubble and edge 12E of the package.

Opening the Package

The bubble is expandable to open the package by external pressure applied by a consumer. For small bubbles, the consumer may simply pinch a bubble or bubbles between his thumb and forefinger. Slightly larger bubbles may require thumb-to-thumb pressure. The very young and older, infirm consumers may push downward on the bubble against a flat surface with a smooth aide such as a spoon. The consumer may direct the bubble expansion outward towards edge 12E of the package by applying the pressure along the inward side of the bubble proximate point "X" (see FIG. 1C). Inward expansion of the bubble is limited because the applied pressure keeps the opposed laminae pressed together in sealing engagement along the inward side. Therefore, expansion due to the directed pressure is primarily outward urging the bubble outward towards the edge of the package, as indicated by the large outward arrow. The outward bubble expansion progressively separates the opposed laminae forming the outer seal, along a moving separation frontier 16F. The frontier moves across the outer seal until the frontier reaches the edge of the package, where the bubble breaches creating edge breach 16B (see FIG. 1E and FIG. 1F)

Opposed pair of peel flaps, upper flap 16U and lower flap 16L, are formed by the opposed laminae of the outer seal along the edge breach as the bubble breaches. These small initial flaps are grasped by the consumer and manually peeled apart further separating the opposed laminae in order to initiate opening the band seal. The flaps are not pre-existing. They are not pull tabs fabricated during the manufacturing or packaging process. The flaps are created as the consumer expands and breaches the bubble in order open the package.

Flap Stretching

The opposed lamina material forming the bubble and the outer seal may stretch slightly under the applied pressure and bubble expansion. A stretching plastic type enclosure material such as mylar provides loose or baggy initial peel flaps (see FIG. 1F). The looseness offers the consumer more gripping material to start peeling the flaps apart.

Flap Enlarging

The initial peel flaps formed along the edge breach become larger in area as the consumer peels the flaps apart (see FIG. 1G and FIG. 1H). This enlarged area first includes some of the opposed lamina material forming the outer seal. As the flaps are peeled further apart, the enlargement includes some of the opposed lamina material forming the bubble, and then some of the material forming the inner seal. This enlarged flap area offers the consumer an even more material to grip as the laminae separation proceeds. The uniform, page-like peeling shown in FIG. 1G illustrates ideal separation of the laminae. The actual peeling may be uneven, irregular, or askew. The opposed lamina material forming the inner seal may be resealable to permit resealing the chamber after the band seal has been opened. The resealing may be established by groove and flange engaging structure along the opposed laminae which are pinched back into sealing engagement by the consumer.

Figure 6:
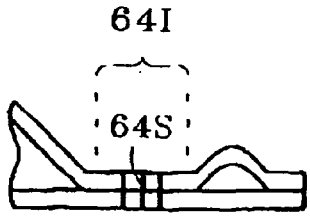
FIG. 6 is a fragmentary view of inner seal portion 64I showing inward expansion stop 64S.

The bubble expands under the applied pressure both outward towards edge 12E of the apparatus and laterally, as indicated by the small lateral arrows (see FIG. 1C). The lateral expansion provides a laterally expanded edge breach with laterally expanded peel flaps. Instead of the directed pressure shown in FIG. 1C, the consumer may press closer to the center of the bubble, causing the bubble to expand in all directions. The bubble may expand under the applied pressure both outward towards the edge of the apparatus and inward towards the inner seal. Inward expansion increases the area of the flaps, which may infringe on the inner seal causing partial preopening. Inward expansion stop 64S formed in inner seal portion 64I (see FIG. 6) may be provided to hinder inward expansion of the bubble towards the inner seal portion. The stop directs all (or at least most) of the bubble expansion outward towards the edge of the apparatus. The stop may be established by employing thicker or stiffer lamina along the inner seal portion. The inner seal portion may be stronger than the outer seal portion due to by a higher temperature and/or pressure during seal formation. That is, the inner seal portion may be fused together more than the outer seal portion.

Figure 2A:
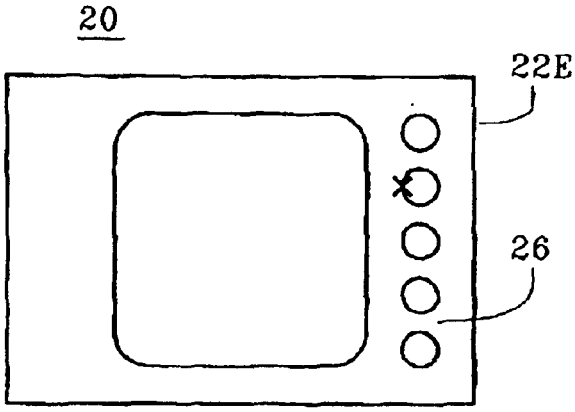
FIG. 2A is a side view of package 20 with a plurality of breaching bubbles 26.
Figure 2B:
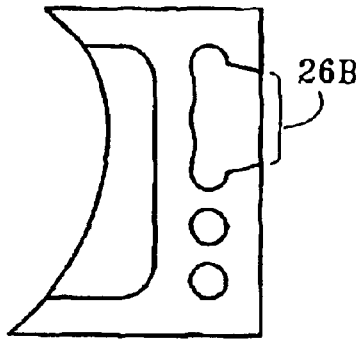
FIG. 2B is an end view of the package of FIG. 2A.

Plurality of Bubbles—(FIG. 2A and FIG. 2B)

The bubble-seal apparatus for opening the storage package may have a plurality of breaching bubbles within the band seal enclosed between the opposed laminae. The plurality of bubbles shown in storage package 20 of FIG. 2A and FIG. 1B form a straight line of adjacent bubbles 26. The consumer may apply breaching pressure to any single bubble, or several bubbles, or all of the bubbles. A bubble under applied pressure at point "X" expands towards package edge 22E, and also expands laterally towards adjacent the bubbles. The expanding bubble merges laterally with the adjacent bubbles, to provide a laterally expanded edge breach 26B with expanded peel flaps.

Figure 3:
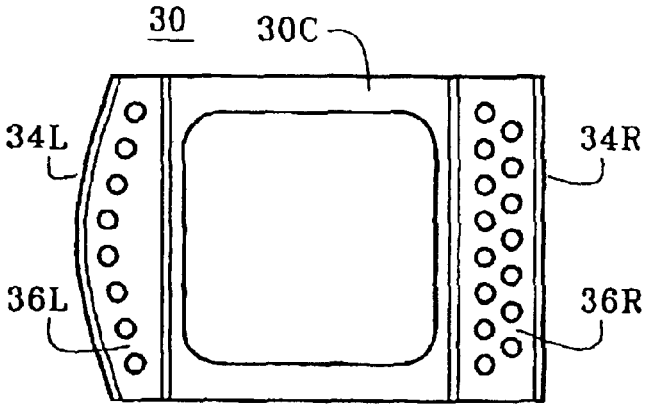
FIG. 3 is a side view of package 30 with two bubble arrays 36R and 36L defining two opening sites.

Multiple Openings—(FIG. 3)

A single storage package may have multiple bubble arrays for providing multiple openings into a single chamber or into multiple chambers. The multiple opening embodiment of FIG. 3 shows storage package 30 with a first opening site 34R along the right edge and a second opening site 34L along the left edge. The first opening site includes a right access region with a right band seal and right bubble array 36R, to provide a right opening into storage chamber 30C. The second opening site includes a left access region with a left band seal and left bubble array 36L, to provide a left opening into the chamber. Multiple opening sites offer the consumer multiple orientations to open. That is, two-site package 30 may be opened at either end. Further, if one bubble array fails to provide adequate peel flaps during breaching, the consumer may try another bubble array.

Bubble Configurations

The bubbles may be randomly arranged, or form an orderly array 36R or sequence 36L as shown in FIG. 3. The bubble sequence and package edge may be irregular or curved. The bubbles may all be the same size and shape, as shown the embodiment of FIG. 2 and FIG. 3. Such uniform bubble configurations create fewer manufacturing considerations. The bubbles may be different sizes. Bubble sequence 46 (see FIG. 4) has large and small bubbles. Large bubbles may facilitate opening the package, but may be at a higher risk of accidentally failing. Small bubbles provide smaller peel flaps, but may be more secure. The bubbles may be different shapes (see FIG. 5). The shape of the bubbles may indicate a particular application of the stored article. The shape (or shapes) of the bubbles may alert the user to a particular application or situation. For example, two critical applications in hospitals are sterility and controlled substances. Surgical gloves and supplies sealed in sterile packages may have one bubble shape such as square bubble 56S; while ordinary, non-sterile equipment may have another bubble shape such as arrow bubble 56A. Narcotics and other prescribed drugs sealed in tamper-proof packages may have a bubble shape easily distinguishable from over-the-counter medications. Further, different types of medications may have different shapes to help avoid confusion in dim lighting during the late shift. The hospital staff can feel (or see) the different shapes and determine the type of medication. Bubble 56A is arrow shaped pointing outward towards the edge of the package in the direction of expansion. The surface texture of a bubble may indicate a particular application of the stored article. A raised surface texture on textured bubble 56T may be impressed onto the bubble from a bubble shaping mold during manufacture. Alternatively the surface texture may be provided by other suitable techniques such as heat deformation, laser etching, and stick-on decals.

Audio/Tactile Feedback

The bubble may provide a distinct breaching sound when an edge is breached indicating that the bubble has breached, and the outer seal has been opened by the expansion of the bubble. A sound inherently comes with bubble breaching. The breaching sound is caused by the rush of air under applied pressure escaping from the bubble through the edge breach during breaching. A large bubble may provide a solid popping sound similar to a small balloon popping. In contrast, small bubbles may just "peep" or whistle sound. A bubble may have a residual internal pressure greater than ambient external pressure to breach faster and provide a firmer bubble with a crisper breaching sound. Soft, spongy bubbles breach slower and make a flatter sound. An "odd" breaching sound, different from the usual sound, may indicate a failing or tampered seal.

Substance in Bubbles

The bubbles may contain a fluid (or fluid-like) substance which is displaced by the applied pressure to cause the bubble expansion. The bubble fluid may be any suitable gas such as an inert gas, or combination of gases, or just ambient air. Alternatively, the bubble fluid may be any suitable liquid such as water (or distilled water) or a substance such as a solvent or oil that cooperates with the stored article after opening. Bubble liquids are less compressible than bubble gases, and provide a firmer bubble. Alcohol may be employed as a bubble liquid. Alcohol remains a liquid at low temperatures which freeze the stored contents, permitting the package to be opened even though the contents are frozen solid. In contrast, bubble water may freeze along with the contents, dictating that the contents (and the bubble water) must be thawed before the bubbles may be edge breached and the package opened. The bubble fluid may contain an active ingredient which alters a visual characteristic of the fluid such as transparency or color when exposed to a contaminate. The contaminate may be an ambient contaminate from the external environment such as oxygen, which enters the bubble through a failed or leaky outer seal. Alternatively, the contaminate may be an internal contaminate given off by the article in the chamber, which enters the bubble through the inner seal. The bubble fluid may have a fragrance distinct from the external environment for indicating outward leakage through the outer seal. Further, the fluid may have a fragrance or flavor distinct from the stored article.

Large Embodiments

The storage package may be large, suitable for bulk transport, such as unloading from trucks or rescue drops of supplies from the air. Food, water, medicines, blankets and other essential supplies may be dropped to famine victims in remote locations and to water bound flood victims. The bubble-seal for this large embodiment may have large bubbles which may be edge breached by foot pressure and/or pressure from a heavy object such as a rock from the rescue site. The recipient places his boot on the bubble and steps down with his full weight to expand the bubble towards edge breach.

Methods For Making Storage/Display Packages with Breaching Bubble Opening Mechanisms U.S. Pat. No. 5,340,632 to Chappuis U.S. Pat. No. 5,942,076 to Salerno et al and U.S. Pat. No. 6,598,373 to Sperry et al each describe examples of machinery and manufacturing techniques for making partially inflated, air filled containers from one or more webs of heat sealable thermoplastic materials in rectangular arrays (Chappuis), and liner strings (Salerno et al and Sperry et al)

The basic methods described by Chappuis, Salerno et al and Sperry et al involves locating or stacking two laminas or plies of thermoplastic material together and forming chambers with combinations heatable welding rods (Chappuis,—FIGS. 4 & 5 at 19 & 26), and/or electrically conductive heating elements (Salerno et al—FIG. 6 at 152 and Sperry et al—FIG. 3 at 66) while or as flowing air is directed (Chappuis,—FIG. 4 at 20 and Sperry et al—FIG. 3 at 42 & 44) or injected (Salerno et al—FIGS. 6 & 7 at 155) between the stacked lamina material The welding rods and/or electrically conductive heating elements are typically pressed against one or the other of the outer surfaces of the stacked lamina of thermoplastic material melting/fusing the two laminas or plies together. In Salerno et al (FIG. 7) a pair of sealing bands or wires 152 are spaced apart such that when they are pressed against the adjacent lamina of the tubular web F they sandwich the holes left by the withdrawing air injection needles 155 fusing the two opposed lamina of web together sealing the upstream edge of the air filled downstream container 10 and the downstream edge of the upstream container being formed.

The above referenced teachings of Chappuis, Salerno et al and Sperry et al are easily adaptable both (i) for forming or establishing the breaching bubble 16, adjacent breaching bubbles 26, bubble arrays 36 & 46 & shaped/textured bubbles 56 in the band seals 14 of the invented breaching bubble opening mechanisms illustrated in FIG. 1–5, and (ii) for forming the respective storage chambers 10C, 30C of the storage bags 10, 20, & 30.

There are essentially three types of storage bags for storing articles including liquids, top loaded bags, side loaded bags and bottom loaded bags.

Figure 4:
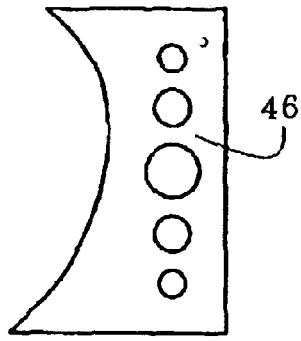
FIG. 4 is a fragmentary view of a package having different size bubbles in bubble array 46.
Figure 5:
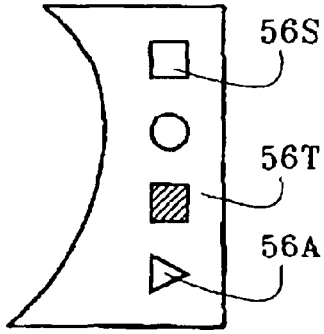
FIG. 5 is a fragmentary view of a package having different shaped bubbles.

For a top storage loaded bag, the invented bubble breaching mechanism must be made or formed after the article is loaded into, and preferably sealed in the storage chamber 10C/30C. In particular, a pre-formed package with a chamber into which an article is already placed and sealed, has a chamber access region adjacent to, and above the chamber extending to the top edge of the package. A breaching bubble in the chamber access region is established between opposed laminae of packaging material forming the package by simultaneously sealing an inner seal portion of a band seal across the chamber access region above the sealed storage chamber, and an outer seal portion along the top edge of the chamber access region forming a bubble band tube. An injection nozzle/needle then directing flowing air into the bubble band tube, inflates it as the far side edge of the chamber access region opposite the air injection nozzle/needle is sealed closed. Then after the bubble band tube is inflated to a pre-determined degree, the near side edge of the access region is sealed together establishing the bubble 16 (FIG. 1). Alternatively, spaced seals can be sequentially made across the bubble band tube inward toward the air injection nozzle/needle for establishing a bubble array (FIGS. 2A, 2B, 3 & 4). In the latter instance the inward inner sides of the outer and inner portions of the band seal 14 (FIG. 1) defining the bubble band tube can be configured to produce desire shapes and locations of the array of bubbles 26/46/56 (FIGS. 2, 4, & 5). The described seals between the opposed laminae material forming the storage package including the access region may be established using shaped heated element bands per conventional techniques, or by using a thermally activated contact glue template placed on the inner surface of one of lamia of packaging material that melts and adheres to the lamina material at a temperature below the melting/fusing temperature of the lamina material, or by combination of heated element bands and contact glue templates.

For a side loaded storage bag the invented bubble mechanism can be made or established as the storage bag is manufactured. Post manufacture, an article is placed into the storage chamber via its open side and the free sided edges of the opposed laminae material forming the chamber are sealed together. In particular, a package is formed with an enclosure material creating a chamber for receiving an article via a sealable gap, e.g., the adjacent juxtaposed side edges of a longitudinally folded web of enclosure material (See Sperry, supra). A chamber access region above the storage chamber proximate a top edge of the package is established by forming inner and outer band portions of a band seal across the access region establishing a bubble band tube as above. Air is directed into the open end of the bubble band tube inflating it to a desire degree whereupon bubble tube is sealed transversely either at its open end to establish a single breaching bubble or in sequential spaced steps toward its open end establishing an array of breaching bubbles.

A side loaded storage bag has an advantage in that articles can be placed in the open access chambers at a station downstream from that establishing the breaching bubble opening mechanism again by directing air for inflating the storage chamber, placing an article in it while inflated and then sealing the free side edges of the storage chamber together.

For bottom loaded storage bags again the invented bubble mechanism can be made or established as the storage bag is manufactured. In particular, two laminae of a web material are juxtaposed or stacked one atop the other. A top band seal is established between the two stacked lamina materials at a topside edge of a storage package array having an outer band portion adjacent the topside edge, and an inner band potion spaced inward from the outer band portion forming a bubble band tube. The bubble band tube is partially inflated by directing air into one of its ends as above. A plurality side edge band seals are established between the two stacked lamina materials each crossing the top band seal, each pair of side edge band seals forming a bubble region in combination with the outer and inner band portions of the top band seal and forming a chamber with an open bottom for receiving an article.

Bottom loaded storage bags have the advantage of being easily manufacture in rectangular arrays from two juxtaposition web sheets (see Chappuis) where severing each row of storage bags from the downstream end of the array adjacent the next upstream top band seal, opens the bottoms of the downstream row of storage bags (see Chappuis and Salerno et al supra).

With both side load and bottom loaded storage bags, separation of the bags from the respective webs can be facilitated by perforations cut within or adjacent the top band seals, and where the storage bags are manufactured in a rectangular array, perforations are cut longitudinally down the center of the respective inward side edge band seals.

CONCLUSION

It will be apparent to those skilled in the art that the objects of this invention have been achieved as described hereinbefore by providing a bubble-seal apparatus for a package which permits easy opening by a consumer. The bubbles are edge breached by consumer applied pressure, which creates small initial peel flaps. By peeling back the flaps, the consumer may manually open the package using only his fingers, without tearing the tough closure material or employing a separate tool. Only light pressure on a single bubble or small groups of adjacent bubbles is required. Audio feedback is provided during the opening process by a rush of air escaping from the breaching bubbles. Tactile feedback is provided by the position and shape of the bubbles.

Various changes may be made in the structure and embodiments shown herein without departing from the concept of the invention. Further, features of embodiments shown in various figures may be employed in combination with embodiments shown in other figures. Therefore, the scope of the invention is to be determined by the terminology of the following claims and the legal equivalents thereof.

I claim as my invention:

1. A method for making an article storage package having a breaching bubble(s) opening mechanism comprising the steps of:

(a) stacking two lamina materials one atop the other;

(b) establishing a top band seal between the two stacked lamina materials at a topside edge of a storage package having an outer band portion adjacent the topside edge, and an inner band potion spaced inward from the outer band portion forming a bubble band tube;

(c) partially inflating the bubble band tube with a fluid;

(d) establishing a plurality side edge band seals between the two stacked lamina materials each crossing the top band seal, each pair of side edge band seals forming a bubble region in combination with the outer and inner band portions of the top band seal and forming a chamber with an open bottom;

(e) placing an article in the chamber via its open bottom, and (f) sealing the open bottom of the chamber enclosing the article for storage.

2. The method of claim 1 and further including a step of:

(g) establishing a bubble forming seal between the stacked lamina materials in the bubble region locating and shaping the breaching bubble(s) of the opening mechanism in the bubble region.

3. The method of claim 1 and further including a step of:

(h) cutting a notch partially into the outer band portion of the top band seal between each pair of side edge band seals in proximity of a breaching bubble providing a point of initiation of a bursting failure of the outer portion of the top band seal responsive to external pressurization of the breaching bubble(s) by a person pressing on the breaching bubble(s).

4. The method of claim 1, 2 or 3 wherein step (c) of partially inflating the bubble band tube with a fluid includes:

(i) directing fluid flow from a source into the bubble band tube.

5. The method of claim 4 wherein step (d) of establishing a plurality of side edge band seals between the two stacked lamina materials includes:

(ii) establishing a $1^{st}$ side edge band seal between the stacked lamina materials proximate a side edge of the stacked lamina material opposite the directed fluid flow source; and (iii) sequentially establishing a 2nd, 3rd, 4th, . . . nth side edge band seal, each side edge band seal being spaced toward the directed fluid flow source from the preceding side edge band seal.

6. The method of claim 5 and further including the steps of:

(l) centrally perforating, longitudinally, each side edge band seal of the stacked lamina inward from the $1^{st}$ and the $n^{th}$ side edge band seals respectively located at the opposite side edges of the stacked lamina materials; and (m) transversely perforating the stacked lamina materials along the topside edge adjacent the outer band portion of the top band seal of a storage package;

wherein each storage bag can be separated from the stacked lamina materials by tearing the stacked lamina materials along the perforations, the inward separated perforated half side edge band seals becoming side edge band seals of adjacent storage bags, and edges of the stacked lamina materials separated from the topside edge of a downstream storage package becoming the open bottom of an upstream storage package.

7. A method for making and easily opening a storage package, comprising the steps of:

forming a package with an enclosure material creating a chamber into which an article is placed and sealed, the formed package also having a chamber access region adjacent the chamber proximate a top edge of the package;

inflating a bubble with a fluid in the chamber access region between opposed lamina of the enclosure material proximate to the top edge of the package;

sealing the opposed lamina of enclosure material of the chamber access region together around the bubble between the sealed chamber and the top edge of the package; and for opening, bursting the bubble expanding the fluid towards the top edge of the package by applying pressure separating the opposed lamina, until the bubble breaches the top edge of the package, and peeling the separated, opposed lamina material apart beginning at the top edge breach providing access to the article sealed in the chamber of the package.

8. A method for making and easily opening a storage package, comprising:

forming a package with an enclosure material creating a chamber for receiving an article via a sealable gap, the package also having a chamber access region proximate a top edge of the package;

inflating a plurality of bubbles with a fluid between opposed lamina of the enclosure material of the chamber access region proximate to the top edge of the package;

sealing the opposed lamina of the enclosure material of the chamber access region together around each of the breaching bubbles in a band across the access region between the chamber and the top edge of the package;

placing an article into the chamber via the sealable gap;

sealing the gap; and for opening, bursting the bubbles and expanding the fluid towards the top edge of the package by applying pressure progressively separating the opposed lamina material, until the top edge is breached, peeling the separated, opposed lamina material apart beginning at the top edge breach providing access to the article sealed and stored in the chamber of the package.

9. A method for making an article storage package having a breaching bubble opening mechanism comprising the steps of:

(a) flattening a longitudinal tube of web material;

(b) establishing an inner top band seal across the flattened longitudinal tube of web material forming a top of an article chamber of the storage package;

(c) partially inflating a bubble with a fluid within the flattened longitudinal tube of web material upstream from the inner top band seal;

(d) establishing an outer top band seal across the flattened longitudinal tube of web material above the bubble forming a top a of the storage package;

(e) severing a downstream storage package transversely from the longitudinal tube of web material immediately upstream and adjacent the outer band portion of the top band seal opening a bottom of an article chamber of a next upstream storage package;

(f) placing an article in the article chamber via its open bottom; and (g) sealing the open bottom of the article chamber enclosing the article for storage.

10. A method for making an article storage package having a breaching bubble opening mechanism comprising the steps of:

(a) folding a continuous sheet of web material longitudinally;

(b) establishing a top band seal traversely across the longitudinally folded sheet of web material at a topside edge of a storage package having an outer band portion adjacent the topside edge, and an inner band potion spaced inward from the outer band portion forming a transverse bubble band tube;

(c) partially inflating the bubble band tube with a fluid;

(d) establishing at least one longitudinal side edge band seal crossing the top band seal, the side edge band seal forming a bubble region in combination with the outer and inner band portions of the lop band seal and forming a chamber with an open bottom;

(e) severing a downstream storage package transversely from the longitudinal folded web material immediately upstream and adjacent the outer band portion of the top band seal opening a bottom of an article chamber of a next upstream storage package;

(e) placing an article in the chamber via its open bottom, and (f) sealing the open bottom of the chamber enclosing the article for storage.

11. A method for making and easily opening a storage package, comprising the steps of:

forming a package with an enclosure material creating a chamber into which an article is placed and sealed, the formed package also having a chamber access region adjacent the chamber proximate a top edge of the package;

inflating a burstable bladder with a fluid;

placing the burstable bladder in the chamber access region between opposed lamina of the enclosure material proximate to the top edge of the package;

sealing the opposed lamina of enclosure material of the chamber access region together around the burstable bladder establishing a bubble between the sealed chamber and the top edge of the package; and for opening, bursting the bladder expanding the fluid in the bubble towards the top edge of the package by applying pressure separating the sealed-together opposed lamina until the bubble breaches the top edge of the package, and peeling the opposed lamina material apart beginning at the top edge breach to access the article sealed in the chamber of the package.

* * * * *